United States Patent [19]

Eberius et al.

[11] 3,979,363

[45] Sept. 7, 1976

[54] METHOD OF PRODUCING POLYURETHANE FILAMENTS

[75] Inventors: Wiprecht Eberius, Elsenfeld; Gerhard Wick, Obernburg; Heinz Grotjahn, Rollfeld; Eckart Jacobs, Obernburg, all of Germany

[73] Assignee: Akzo N.V., Arnhem, Netherlands

[22] Filed: Nov. 7, 1973

[21] Appl. No.: 413,552

[30] Foreign Application Priority Data

Nov. 18, 1972 Germany ..... 2256664

[52] U.S. Cl. ..... 260/77.5 AT; 8/115.5; 260/77.5 SP; 264/184; 264/210 F

[51] Int. Cl.[2] ..... C08F 18/24; D01F 6/00

[58] Field of Search ..... 260/77.5 SP, 77.5 AX; 264/184, 210 F; 8/115.5

[56] References Cited

UNITED STATES PATENTS

| | | | |
|---|---|---|---|
| 3,233,019 | 2/1966 | Adams | 264/290 |
| 3,401,151 | 9/1968 | Wieden et al. | 260/77.5 SP |
| 3,454,671 | 7/1969 | Oertel et al. | 260/77.5 SP |
| 3,461,101 | 8/1969 | Oertel et al. | 260/77.5 SP |
| 3,553,173 | 1/1971 | Wieden et al. | 260/77.5 SP |
| 3,627,735 | 12/1971 | Trapasso | 260/77.5 SP |
| 3,630,657 | 12/1971 | Setzer | 264/210 F |
| 3,793,238 | 2/1974 | Wrakelmann et al. | 260/77.5 SP |

*Primary Examiner*—Jay H. Woo

*Attorney, Agent, or Firm*—Johnston, Keil, Thompson & Shurtleff

[57] ABSTRACT

Polyurethane elastomeric filaments of improved physical properties and chemical resistance prepared by preforming the filamentary material such that the polyurethane contains at least about 100 up to about 700 milliequivalents/kilogram of reactive terminal amino groups, and then aftertreating this preformed filamentary polyurethane, optionally under simultaneous stretching, with an organic polyisocyanate and then preferably heating the treated material at an elevated temperature above about 140°C. The polyurethane filamentary product is particularly useful in providing durable elastic filaments, fibers, threads, yarns, fabrics and similar textile materials.

23 Claims, No Drawings

METHOD OF PRODUCING POLYURETHANE FILAMENTS

It is known that polyurethane filaments may be produced by various spinning processes. For example, polyurethane can be formed into filaments in the so-called melt spinning process by the use of a screw extruder. It is further known that one can produce polyurethane solutions from which filaments may be formed by the dry spinning process or the wet spinning process. Also known are the so-called reaction spinning processes in which a reactive initial material is extruded through nozzles or spinning orifices into a spinning bath which contains component capable of reacting with the extruded material in the bath to form the filaments.

Processes for the production of polyurethane filaments are described for example in German Pat. No. 1,161,007. However, this patent concerns only the use of very special polyurethanes which are derived from hydrazine or substituted hydrazines. The fibers or filaments obtained according to the teaching of this patent exhibit a number of disadvantages. For example, these filaments are very sensitive to the effect of sodium hypochlorite which is a common bleaching agent. Also, the tension or stress characteristics of these filaments in the lower ranges of its elongation or strain leave much to be desired.

In U.S. Pat. No. 3,164,439, a process is described in which there is first produced a solution of a conventional fiber-forming polyurethane product, and this solution is then formed into filaments which, upon their completion, are treated with a solution of an organic polyisocyanate. The filaments treated in this manner also may be subjected to a heating at temperatures of about 100°C. to 120°C. It is a recognized disadvantage of the process disclosed in this patent that the unstretched filaments must be subjected to the required conditions for a relatively extended period of time, and this is most unsatisfactory in any commercial process.

Other disadvantages are discussed in U.S. Pat. No. 3,630,657 which describes a further improvement wherein stretched polyurethane fibers or filaments of the spandex type are treated with a diisocyanate and simultaneously stretched at 20°–40°C., thereafter being dried. In this manner, however, one merely obtains filaments with a substantially reduced elongation of at most about 200 to 300%.

With the known state of the art, there still exists a requirement for improved polyurethane filaments, fibers, yarns, threads and the like, especially with respect to a greater resistance to hydrolytic influences and the effects of gases such as nitrosyl gases. At the same time, the filaments must exhibit good stretch or elongation properties.

One object of the present invention is to provide a method of producing elastomeric polyurethane filaments exhibiting an overall improvement of properties. Another object of the invention is to provide a method of producing such filaments in a rapid and simple manner. These and other objects and advantages of the invention will become more apparent upon consideration of the following detailed specification.

It has now been found, in accordance with the invention that the foregoing objects are achieved in a combination of method steps comprising preforming an elastomeric filamentary polyurethane which contains at least about 100 up to approximately 700 milliequivalents/kg. of terminal primary or secondary amino groups or a mixture thereof, and then aftertreating the preformed filamentary polyurethane with an organic polyisocyanate. While 700 milliequivalents per kilogram of the polyurethane polymer generally represents an upper limit to the proportion of the amino "end groups" in the polymer, it is preferable to choose a maximum of 500 milliequivalents per kilogram of polymer. Especially favorable results are achieved with preformed polyurethane filaments containing about 200 to 400 milliequivalents/kg. of the amino end groups.

These terminal amino groups must be reactive amino end groups, i.e. at least a secondary and preferably a primary amino group which contains at least one and preferably two hydrogen atoms. A reactive hydrogen atom on such an amino group is essential for reaction with the organic polyisocyanate in the second step of the invention. Especially suitable elastomeric filaments of polyurethane are those which contain aliphatic amino end groups, i.e. a terminal group which has an aliphatic structure and especially an aliphatic hydrocarbon structure aside from amino nitrogen atoms.

During the aftertreatment with the organic polyisocyanate, the filaments can be stretched by about 10 to 130% as an especially preferred measure. Also, the method of the invention is best carried out by a subsequent heating of the polyisocyanate treated filaments at an elevated temperature of 140°C. to 190°C., preferably within a range of approximately 160°C. to 180°C.

The essential aftertreatment is generally possible with any organic polyisocyanate but diisocyanates and especially aliphatic diisocyanates have been found most suitable. Moreover, it is especially useful to apply the diisocyanate with a 0.05 to 1.5 normal solution thereof in an organic solvent. Higher concentrations of the diisocyanate are also possible, and the aftertreatment can even be carried out with very highly concentrated or pure diisocyanates.

Among the diisocyanates, it has been found that hexamethylene-diisocyanate is very suitable. As organic solvents for the isocyanate used in the aftertreatment of the filaments, toluene is especially recommended.

In an especially advantageous embodiment of the process according to the invention, the preformed filamentary polyurethane is one which has been obtained by extruding a prepolymer of the polyurethane containing terminal isocyanate (—NCO) groups into a spinning bath containing a diamine. Again, aliphatic diamines are especially preferred, for example by using a spinning bath consisting of an 0.3 to 3 normal solution of the diamine in an aromatic hydrocarbon solvent. Especially preferred are spinning baths of an about 0.5 to 2.5 normal solution of ethylenediamine in toluene. The polyurethane prepolymer is advantageously one obtained as the reaction product of initial polymers containing terminal hydroxy groups with an excess of toluene-diisocyanate. A very suitable prepolymer is also one obtained as the reaction product of a polyester containing terminal hydroxy groups and a polyisocyanate. In this case, it is preferable to employ the reaction product of toluene-diisocyanate and a polyester containing said terminal hydroxy groups wherein the polyester is one obtained by conventional reaction of a glycol, a dicarboxylic acid or their derivatives forming esters and about 0.2 to 1.5 mol percent of a trivalent alcohol, i.e. so as to provide substantially linear saturated polyesters with a small proportion of the trivalent alcohol (containing three hydroxy groups) to provide the desired number of terminal hydroxy groups in the initial polymer.

The production or preforming of the elastomeric polyurethane filaments and the aftertreatment of these filaments according to the invention are preferably carried out in a continuous operation, i.e. as successive steps on a continuously conducted polyurethane filamentary material in the form of a thread, yarn or similar bundle of preferably non-twisted filaments or fibers. The final product of the invention as obtained by the prescribed method of preforming and treating the filamentary material is unique in its improved properties by comparison to polyurethane filaments obtained according to previously known method.

The preparation of polyurethanes is generally known and standard literature on this subject are incorporated herein by reference as fully as if set forth in its entirety. For example, polyurethanes generally require the reaction of compounds having a reactive hydrogen atom with a polyisocyanate. Note the reactions as described in "Polyurethanes" by Dombrow, Reinhold Publishing Corporation (1957) and subsequent publications on this subject. Compounds with reactive hydrogen atoms include for example: glycols, diamines or also polymeric substances with reactive hydrogen atoms as well as mixtures of these and similar materials. It is only necessary that the resulting amount of amino end groups, and for this reason, it is desirable at some point in the preparation of the prepolymer to employ a sufficient amount of multivalent compounds with primary and/or secondary amino groups.

In the production of the polyurethanes which are to be subjected to the treatment of the invention as filaments, threads or the like, it is especially favorable to first produce a polymer containing hydroxy end groups. Suitable polymers of this kind include polyesters, copolyesters, polyethers, copolyethers, polyetheresters, polylactones and polyesteramides containing terminal hydroxy groups. If these polymers contain only two terminal hydroxy groups, they may be referred to as macrodiols. Such macrodiols are produced for example by polycondensation of dicarboxylic acids and glycols or their derivatives, i.e. by reaction of divalent reaction components or monomers. Substances can also be introduced as macrodiols obtained by reaction of one mol of a diisocyanate and two mols of a macrodiol. As polymers containing terminal hydroxy groups, one can also make use of those polymers in which small amounts of trivalent initial monomeric materials are introduced in addition to the divalent substances which lead to substantially linear polymers. Some cross linking will thereby occur to a limited extent while still providing the desired terminal hydroxy groups. As trivalent monomers, for example, glycerine and trimethylol-propane are especially suitable.

These polymers having hydroxy end groups are then reacted with a polyisocyanate, preferably a diisocyanate. In general, this reaction is carried out with an excess of the diisocyanate to provide a prepolymer containing isocyanate end groups. The reaction occurs primarily in the melt, i.e. in the molten polymer admixed with the diisocyanate. The molecular weight of the polymer containing terminal hydroxy groups generally lies between about 500 and 5,000. Again, toluenediisocyanate is especially suitable as the diisocyanate for reaction with the polymer. The excess of the diisocyanate or polyisocyanate is usually about 50 to 250%, preferably 50 to 200%, with reference to the terminal hydroxy groups to be reacted.

The resulting prepolymer containing these isocyanate end groups is then further reacted with a suitable compound containing reactive hydrogen atoms so as to form the polyurethane. In order to obtain a polyurethane which exhibits the required proportion of terminal amino groups, it is necessary to introduce the corresponding amount of multivalent compounds with the desired primary and/or secondary amino end groups. For this purpose, the following diamines are especially suitable: 1,3-diaminopropane; 1,4-diaminobutane; 1,4-diaminocyclohexane; 3,3'-diaminopropylether; piperazine; N,N'-dimethylethylenediamine. Ethylenediamine is particularly useful for purposes of the present invention. For the most part, it is desirable to select a lower molecular weight diamine of up to about six carbon atoms, preferably with a saturated hydrocarbon structure aside from the amino groups but without excluding other hetero atoms such as the oxygen of an ether compound or intermediate imino nitrogen atoms or the like. Primary amines are particularly preferred but mixtures of primary and/or secondary amines may be used.

The added amount of the diamine is dependent in part upon the molecular weight of the prepolymer of polyurethane. It is usually desirable to employ a small excess of diamine to convert all of the isocyanate end groups of the prepolymer by reaction with the diamine component to form urea groups leaving a small amount of primary or secondary amino end groups unreacted.

The resulting polyurethanes containing the desired proportion or number of terminal amino groups is thus prepared in a conventional manner, the only important feature being the necessity of introducing at least 100 and preferably 200 or more milliequivalents of amino end groups per kilogram of the polymer. An excessive number of amino end groups should also be avoided to prevent any tendency of excessive cross linking. Variations in the preparation of the initial polyurethane containing amino end groups may be readily adapted from known preparations, particularly in achieving a large number of equivalent elastomeric fiber-forming polyurethane structures.

The polyurethane is then formed into filaments, e.g. as obtained by spinning or otherwise extruding the polymer in a conventional manner to achieve the spandex type of filament. The term "spandex" is employed to define the resulting elastomeric filament or fiber which has elastic properties on the order of those exhibited by rubber filaments and which is made up of at least 85% polyurethane in segmented units.

In addition to melt-spinning for the formation of the polyurethane filaments, it is also possible to employ solutions of the polymer in conventional solvents so as to produce filaments by the so-called "wet" or "dry" spinning processes. In working with polyurethanes which are especially sensitive to the influences of the atmospheric environment, a protective or inert gas is recommended during spinning of the filaments.

The filaments being spun according to he invention yield a preformed filamentary polyurethane exhibiting at least 100, preferably at least 200 milliequivalents/kg. of the amino end groups having a reactive hydrogen atom. These amino end groups make up at most 700 and preferably not more than about 500 milliequivalents/kg. of the polymer. Optimally, the preformed polyurethane filaments contain about 200 to 400 milliequivalents/kg. of the amino end groups. Within these ranges, the particular number of amino end groups is readily adjusted by selection of a suitable ratio of the added diamine to the remaining initial materials. Also, the content of the terminal primary and secondary amino groups can be readily determined by means of appropriate analytical techniques which are well known in this art. Such techniques are generally directed to relatively active hydrogen atoms so that tertiary amino groups and even groups such as those associated with urea compounds are not detected. It is thus possible to very closely identify the proportion of terminal amino groups in the polymer so that various standard polyurethane prepolymers and preformed filaments are easily established with only routine experimentation. The properties of the filaments, both before and after treatment with the polyisocyanate according to the invention, are also readily determined in a conventional manner.

One approved method of establishing the composition of the spun filaments is as follows. The elastomeric preformed polyurethane filaments are purified or cleaned by agitation in petroleum ether and then dried in a vacuum. An exactly weighed portion of the filaments are then exposed for 30 minutes to a saturated n-butylisocyanate atmosphere. To accomplish this exposure, the filaments are suspended in a 2-necked flask equipped with a cooling means and a magnetic stirrer, the flask containing the n-butylisocyanate. The flask is heated by means of a water bath maintained at 80°C. Then, the filaments are dried for 2 hours at 80°C. in a drying pistol under an oil-pumped vacuum up until the weight remains constant. The number of terminal amino groups can then be readily calculated from the initial and final weights of the filament sample.

The polyurethane filaments obtained by spinning and containing the requisite number of terminal amino groups are first preferably dried and then subjected to aftertreatment with the polyisocyanate. For the aftertreatment according to the invention, diisocyanates and especially aliphatic diisocyanates are suitable, and hexamethylene-diisocyanate-(1,6) has proven to be of special value. The treatment can take place in a number of ways. For example, the organic polyisocyanate can be sprayed directly onto the filaments. It is also possible and more convenient, however, to draw the filaments through a bath containing the organic polyisocyanate, preferably a solvent-soluble diisocyanate. On the other hand, the filaments can also be conducted over a godet or similar roller on which there is located a film or layer of the treating agent sufficiently deep to completely coat or contact the filament surfaces.

It is advantageous to apply the polyisocyanate with a suitable organic solvent but it is not absolutely necessary to use such a solvent. When used, the solvent is inert to the reactive amino groups although it may cause some swelling of the polyurethane filaments. The amount of solvent can vary over a wide range. However, it is preferred to treat the filaments with a 0.05 to 1.5 normal solution of a diisocyanate in the organic solvent. In addition to the especially preferred use of toluene as the solvent, one can also very readily use other suitable solvents such as benzene, xylene, benzin (b.p. 70°–90°C.) or similar aromatic or aliphatic hydrocarbon solvents. Also suitable are di-n-butylether, tetrachloroethylene or mixtures of such solvents, all of which are generally known as isocyanate solvents. It is only necessary that the organic polyisocyanate be soluble in the solvent without undergoing a reaction with the solvent which in itself must also be chemically inert to the polyurethane filaments.

It is also very favorable to stretch or elongate the polyurethane filaments at the same time that they are being aftertreated with the organic polyisocyanate. A stretching of about 10 to 130% is especially advantageous. This stretching is readily achieved by positioning feed and draw rolls before and after the treatment zone, respectively, i.e. the draw rolls being run at a peripheral speed which is sufficiently greater than the speed of the feed rolls to produce the desired amount of stretch on the continuously running filaments.

After the treatment in which the filaments are contacted with the organic polyisocyanate, with or without stretching, they are subjected to a heat treatment at an elevated temperature. This temperature may be varied over a relatively wide range. However, it is advisable to employ a temperature of at least 100°C., and particularly above 130°C., preferably in a range of about 140°C. to 190°C. with temperatures of approximately 160°–180°C. being especially favorable. This heat treatment, especially within the higher range of preferred temperatures, lasts only a very short period of time, for example within a period of about 4 to 120 seconds, it being most useful to complete the heating in less than a minute and preferably in about 10 to 30 seconds. This heat treatment may be readily accomplished with conventional apparatus, for example in a heated zone such as a heating chamber or a heated tubular oven or the like. Heating can be accomplished generally under otherwise normal atmospheric conditions, i.e. with air. However, for very careful quality control, heating of the filaments in an inert gas is recommended.

For purposes of the present invention, it has been found to be of special technical advantage to extrude or spin the prepolymer containing terminal isocyanate groups into a spinning bath containing a diamine. The prepolymer filament itself is produced in this way analogous to the finished polyurethane filament described above. Thus, the prepolymer containing isocyanate end groups is degassed in its preparation and conducted to a spinning tank or spinning head provided with a pump. This pump is connected to the spinning nozzle or spinning die plate containing the spinning orifices which are immersed in the spinning bath. For example, a spinning nozzle may be used with generally about 1 to 44 openings or spinning orifices, each having a diameter of about 90 to 240 microns. Especially suitable are spinning orifices of 150 to 180 microns. A V4A-steel alloy is conventionally used to construct the spinning nozzle. Platinum/iridium alloys are also useful in this construction.

The prepolymer is extruded into the spinning bath, most advantageously such that the resulting filament or thread has a linear velocity of about 25 to 150 meters/minute, preferably 50–100 m/min., as it is drawn through the spinning bath. For a spinning nozzle having a total (spinning) cross section of $32.10^{-4}cm^2$, the output velocity amounts to about 8 to 32 $cm^3$/min.

The spinning bath used in this preferred embodiment of the invention is a solution of the diamine in any of a number of useful organic solvents, there being preferred for example: benzene; o-, m- or p-xylene; ethyl benzene, benzine with a boiling point of more than 90°C.; cyclohexane; mixtures of aromatic and aliphatic hydrocarbons; and the like. Also, there may be used those alcohols which are relatively inactive with respect to the isocyanate, for example, isopropanol, sec.-butanol or tert.-butanol. The aromatic hydrocarbon solvents are especially suitable for this spinning bath, toluene being most highly recommended. As diamines applied with this bath for the introduction of the amino end groups, there is again preferred the following: 1,3-diaminopropane; 1,4-diaminobutane; 1,4-diaminocyclohexane; 3,3'-diaminopropylether; piperazine; and N,N'-dimethyl-ethylenediamine. Also, other relatively low boiling aliphatic primary and secondary diamines are generally useful. These diamines may be used individually or as mixtures with each other.

The length of the spinning bath is suitably about 10 to 300 cm., preferably 20–80 cm., depending upon the draw off speed of the spun filaments. The retention time of the filaments in the spinning bath is quite short, generally well below 10 seconds and especially less than 5 seconds. In most cases, a retention time of about 0.5 to 1.5 seconds is quite sufficient to achieve the desired incorporation of the amino end groups.

Also, the concentration of the diamine in the spinning bath is adjusted to ensure the reaction of the prepolymer containing isocyanate end groups into a product with the corresponding number of amino end groups. Thus, one preferably uses a spinning bath which consists essentially of a 0.3 to 3 normal solution of the diamine in an aromatic organic solvent. Such concentrations of ethylenediamine in toluene are especially suitable. It will be self-evident that one need not employ the same solvent in both the spinning bath and in the aftertreatment of the preformed filament with the polyisocyanate. However, in this especially desirable embodiment of the invention, it is advantageous to employ the same solvent in both instances, i.e. in the spinning bath containing the diamine and also in the aftertreatment liquid containing the organic polyisocyanate.

As the polyurethane propolymer to be extruded or spun into the diamine-containing solvent of the spinning bath, those polymers are especially suitable which have been obtained by reaction of polymers containing terminal hydroxy groups with an excess of toluenediisocyanate. For example, polyesters with the requisite number of hydroxy end groups are especially preferred, for example as obtained by the polycondensation of glycols with dicarboxylic acids or their ester-forming derivatives, e.g. the glycol monoester of the dicarboxylic acid, while including about 0.2 to 1.5 mol percent of a trivalent alcohol such as glycerin or trimethylol propane. Such a polymer, when spun as the prepolymer filament, is resistant to the stresses applied during the draw-off and has sufficient strength to be subjected to the subsequent treatments at reasonably high speeds.

By means of the method according to the invention, polyurethane filaments of the spandex type are obtained with outstanding properties in an especially simple and convenient manner. The aftertreatment of the preformed filaments is carried out very easily and economically, i.e. without requiring a large expenditure for apparatus. Above all, the completely treated filaments are obtained in a very short period of time, and the aftertreatment can be joined directly with the spinning of the initial filaments so that one can rapidly produce filaments, threads, yarns, and the like with the required properties. This means that the method of the invention is especially suitable for processes in which it is necessary or desirable to achieve a high efficiency together with a rapid material throughput. Also, the space requirements for the aftertreatment according to the invention is extremely small because both the aftertreatment with a polyisocyanate and also the subsequent thermal treatment at an elevated temperature can be carried out in a very small space or treatment zone.

The filaments or fibers obtained by the process of the invention are characterized by an improved stability against hydrolysis while simultaneously exhibiting outstanding mechanical or physical properties. In particular, the filamentary polyurethane product of the invention has a high breaking length and relatively high tensile strength as well. Also, the residual extension of the filaments when repeatedly stretched and relaxed is quite low, this property being essential in the use of elastic fabrics which must retain their shape. Thus, the elasticity of the product is very good and this property is well retained in textile materials produced from the filaments or fibers of the invention.

The polyurethane filaments obtained according to the invention also exhibit very good resistance to nitroso gases and the effects of heat. In comparison to known polyurethane filaments, they also show less of a tendency toward discoloration so that it is often unnecessary to add stabilizers, for example those additives which are ordinarily used to prevent discoloration due to ultraviolet light present in normal daylight. This is of special advantage because one can produce very stable filaments which are accessible from polyurethane compositions which can be introduced either without a stabilizing agent or with only a substantially reduced amount thereof.

Special attention is directed to the improved stress or tension values of the filaments of the invention in the lower ranges of strain or elastic elongation. For example, in the elastic range of elongation up to about 150%, the tension values are substantially better than with comparable known filaments of the spandex type. Another favorable feature of the invention is the fact that the relative variations in the technical properties of the filaments after different treatments such as washing, cleaning, drying at high temperatures, etc., is exceptionally slight so that textiles produced from these filaments are dimensionally stable and exhibit very constant wearing properties over a long period of time.

A still further advantage of the invention resides in the fact that the elastomeric polyurethane filaments can be produced over a much broader range of yarn or filament size, i.e. the titer or denier as now more commonly measured in units of "tex" or "dtex". The so-called tex number corresponds to the denier number divided by 9 (Tex = Denier Number/9), generally rounded off to a whole number. Since the denier number equals the weight in grams of 9,000 meters of filament or yarn, then the tex number represents the weight in grams of 1,000 meters. The dtex number is the tex number multiplied by 10 (dtex = 10 tex). For example, with the method of the invention, one can obtain very good properties in a fine yarn size, e.g. with yarns of dtex 78f4 or dtex 56f4, (representing yarns of 4 filaments each and a total yarn size of 78 dtex and 56 dtex, respectively).

The invention is further illustrated by the following examples which require some initial explanation.

The so-called NO-test mentioned in the examples is carried out in the following manner:

On a small rigid card with a size of about 4×6.5 cm. and having an opening near its upper edge, the elastomeric yarn to be tested is wound with the aid of a stirring motor with clamps to hold the card to give a wound sample 4 cm. wide. The material of the card itself is a paperboard which has been impregnated with a bright lacquer composed of a $TiO_2$-containing phenol-formaldehyde precondensate and then heated at 150°C.

The small card with the elastomeric yarn sample is suspended for 10 minutes in a petroleum ether bath well mixed with a magnetic stirrer and is then dried for about 15 minutes in an exsiccator under a weak vacuum and in an air stream. With the aid of a reflection spectral photometer, the luminance factor or degree of reflection $R_v$ is measured with light of a wavelength of 460 nm, with reference to an ideal dull white surface.

The small card is then fastened in a test holder mounted vertically in the exsiccator and exposed to nitrogen oxide gas for 30 minutes. The exsiccator has a volume of 6 liters and contains a porcelain insert provided with many small openings, while the gas is opened to the ventilating cock in the cover of the exsiccator. The degree of reflection $R_n$ is again measured after this gas exposure.

For the generation of the nitrogen oxides, there are rapidly mixed for each test about 20 ml. of a 1% by wt. aqueous sodium nitrite solution with 2 ml. of a 10% by wt. hydrochloric acid in a shallow evaporating dish placed in the lower portion of the exsiccator.

In the examples, the quotient $$R_Q = \frac{R_n}{R_v},$$

i.e. the quotient of the value $R_n$, which is the degree of reflection after gassing with nitrogen oxides, divided by $R_v$, which is the degree of reflection before gassing, is a measure of the stability of the yarn sample.

The particular samples being measured and the various test results are explained in greater detail in the following examples. It must be noted that the invention is not limited to these examples which are intended only to illustrate the most preferred embodiments of the invention. Parts are parts by weight unless otherwise noted.

EXAMPLE 1

A polyester is synthesized from 3 parts ethylene glycol, 1.5 parts propylene glycol, 0.1 part glycerine and 10 parts adipic acid, the resulting polymer having a molecular weight of 3700 and a hydroxy number of about 35. This polyester is mixed with 1.4 parts toluene-diisocyanate and maintained at 90°C. for ½ hour. The mixture is then further heated for one and one-half hours at 95°C. A product is thereby obtained with a viscosity of 220 poise at 50°C., which is composed of a macro-diisocyanate or macrotriisocyanate and partly of still unreacted toluene-diisocyanate.

This isocyanate-containing product is extruded at 60°C. through a steel alloy spinning nozzle having 16 openings of a diameter of 0.16 mm., directly into a spinning bath maintained at 38°C. The spinning bath consists of a 3% solution of ethylenediamine in toluene as the inert solvent.

After drying and tempering (heat treating) in an oven of 18 meters in length at a temperature of 160°C., the spun yarn which exhibits a content of terminal amino groups of 200 milliequivalents/kg. is conducted through a 60 cm. long aftertreatment bath which contains a 5% solution of hexamethylenediisocyanate in toluene.

The yarn is subsequently conducted through a second oven of 18 meters in length at 170°C. and finally wound onto a bobbin at a speed of 112 meters per minute.

In the following Table I, the properties of the polyurethane yarn is given in comparison to the data of yarns which have been tempered (heat treated) after leaving the spinning bath at temperatures of 160°C. and 205°C., respectively, and omitting the aftertreatment with a polyisocyanate.

TABLE I

| | ELASTOMERIC YARN | | |
|---|---|---|---|
| | A. Treated with hexamethylene-diisocyanate and tempered at 160°C. | B. Tempered at 160°C. without polyisocyanate treatment. | C. Tempered at 205°C. without polyisocyanate treatment. |
| 1. Yarn size (dtex) | 520 (545) | 531 (596) | 535 (570) |
| 2. Breaking strength (Reiss-km.) | 7.5 (7.2) | 2.8 (1.4) | 5.4 (4.1) |
| 3. Breaking elongation (%) | 570 (580) | 596 (630) | 700 (730) |
| 4. Stress at 300% elongation, 5th draw (grams/tex) | 1.06 (0.90) | 0.34 (0.23) | 0.50 (0.38) |
| 5. Permanent set (%) | 18 (15) | 26 (25) | 24 (24) |
| 6. NO-test:$R_Q$ | 0.65 | 0.73 | 0.25 |

The reflection quotient $R_Q$ as noted above is given by the equation:

$$R_Q = \frac{R_n}{R_v} = \frac{\text{Degree of reflection after NO-treatment}}{\text{Degree of reflection before NO-treatment.}}$$

The values given in the parentheses of Table I above and in the further tables below are measured after a hydrolysis treatment. This hydrolysis test consists of a one-hour washing at the boil of the yarns in a solution of 3 g/l Blankit (sodium dithionite) and 2 g/l of Foryl D (a sulfonate washing agent) in water.

EXAMPLE 2

The yarn produced according to Example 1 is conducted through a 60 cm. long bath at room temperature, said bath containing a solution of 6% p-xylylene-diisocyanate in toluene rather than the hexamethylene-diisocyanate of the preceding example. Otherwise, the same procedures are followed as in Example 1. After treatment at 170°C. and spooling onto the bobbin at 112 meters/min., there is obtained an elastomeric yarn with the following properties:

TABLE II

| | | |
|---|---|---|
| 1. | Yarn size (dtex) | |
| 2. | Breaking strength (Reiss-km.) | 6.3 (6.0) |
| 3. | Breaking elongation (%) | 550 (600) |
| 4. | Stress at 300% elongation, 5th draw (grams/tex) | 0.80 (0.68) |
| 5. | Permanent set (%) | 20 (19) |
| 6. | NO-test, $R_q$ | 0.55 |

EXAMPLE 3

The yarn according to Example 1 is processed as in the preceding example 2 in the 60 cm. long bath at room temperature using as the bath liquid a solution of 7% isophorone-diisocyanate in toluene. After the heat treatment at 170°C. and spooling at 112 meters/min., an elastomeric yarn is obtained with the following properties:

TABLE III

| | | |
|---|---|---|
| 1. | Yarn size (dtex) | |
| 2. | Breaking strength (Reiss-km.) | 6.3 (6.1) |
| 3. | Breaking elongation (%) | 570 (600) |
| 4. | Stress at 300% elongation, 5th draw (grams/tex) | 0.81 (0.71) |
| 5. | Permanent set (%) | 21 (19) |
| 6. | NO-test, $R_q$ | 0.56 |

EXAMPLE 4

The prepolymer produced in Example 1 is extruded at 60°C. by using in this instance a steel alloy nozzle with 8 openings of a diameter of 0.16 mm., directly into a spinning bath maintained at 37°C. This spinning bath consists of a 4% by wt. solution of ethylenediamine in toluene.

The resulting filaments as a yarn are drawn off continuously from the spinning bath with the aid of a steel roller which runs at a velocity of 61.0 meters/min. and are conducted through an 18 meter long oven heated at 160°C. The transport of the yarn through this oven occurs with the help of a conveying band which runs at 63.0 meters/min. The spun yarn, which consists of the preformed filaments having an amino end group content of 225 milliequivalents/kg. of polymer, is led from the oven directly through an aftertreatment bath which contains a 6% by wt. solution of hexamethylene-diisocyanate (HDI) in toluene. The immersion length or zone in the bath amounts to 50 cm. With the aid of two sets of rollers, one arranged before and one after the aftertreatment bath, the filaments are stretched during the immersion by about 70%. Subsequently, the filaments are run through a second oven, likewise 18 meters long, heated at a temperature of 160°C. Finally the filaments are wound as a yarn at a speed of 70 meters/min.

In the following table, the textile data of this elastomeric polyurethane yarn is set forth in comparison to the same yarn without the aftertreatment with hexamethylene-diisocyanate (HDI).

TABLE IV

| | | ELASTOMERIC YARN | |
|---|---|---|---|
| | | A. Aftertreatment with HDI and tempered at 160°C. | B. Tempered at 160°C. without HDI treatment |
| 1. | Yarn size (dtex) | 181 (191) | 180 (200) |
| 2. | Breaking strength (Reiss-km.) | 8.3 (7.3) | 6.0 (4.2) |
| 3. | Breaking elongation % | 560 (580) | 590 (630) |
| 4. | Stress at 300% elongation, 5th draw (grams/tex) | 1.02 (0.94) | 0.83 (0.55) |
| 5. | Permanent set (%) | 19 (19) | 25 (25) |
| 6. | NO-test, $R_q$ | 0.64 | 0.26 |

EXAMPLE 5

The prepolymer produced according to Example 1 and the spun yarn according to Example 4 are drawn off at a velocity of 87 meters/min. and tempered in a first oven at 180°C. The aftertreatment took place exactly as in Example 4 but with a 50% stretch in the HDI bath. In the second oven, the yarn was further at a speed of 100 meters/min. This elastomeric yarn exhibited the following textile properties:

TABLE V

| | | |
|---|---|---|
| 1. | Yarn size (dtex) | 174 (192) |
| 2. | Breaking strength (Reiss-km.) | 8.6 (6.9) |
| 3. | Breaking elongation (%) | 570 (610) |
| 4. | Stress at 300% elongation, 5th draw (grams/tex) | 0.90 (0.75) |
| 5. | Permanent set (%) | 19 (19) |
| 6. | NO-test, $R_q$ | 0.60 |

EXAMPLE 6

The prepolymer produced as in Example 1 and the spun yarn according to Example 4 are drawn off with the aid of a godet which is dipped into a pure hexamethylene-diisocyanate so as to soak the yarn. During this soaking or wetting procedure, the elastomeric yarn is stretched by 70% on the godet. The following textile properties are observed in the resulting yarn:

TABLE VI

| | | |
|---|---|---|
| 1. | Yarn size (dtex) | 176 (189) |
| 2. | Breaking strength (Reiss-km.) | 8.8 (7.8) |
| 3. | Breaking elongation (%) | 570 (580) |
| 4. | Stress at 300% elongation, 5th draw (grams/tex) | 0.98 (0.83) |
| 5. | Permanent set (%) | 17 (17) |
| 6. | NO-test $R_q$ | 0.52 |

EXAMPLE 7

The prepolymer produced according to Example 1 is extruded at 60°C. in a steel alloy nozzle having 4 openings of a diameter of 0.2 mm. directly into a spinning bath maintained at 35°C. The spinning bath consists of a 6% by wt. solution of ethylenediamine in toluene.

The spinning of the filaments occurs in the same manner as given in Example 4, by the resulting yarn prior to aftertreatment with the diisocyanate exhibits a content of amino end groups of 271 milliequivalents/kg. The aftertreatment with a pure hexamethylene-diisocyanate occurs as in Example 6. During the wetting of the yarn with this diisocyanate, the yarn is stretched by about 50%. The textile properties of the treated yarn are as follows:

TABLE VIII

| | | |
|---|---|---|
| 1. | Yarn size (dtex) | 170 (189) |
| 2. | Breaking strength (Reiss-km.) | 8.7 (7.7) |
| 3. | Breaking elongation (%) | 550 (585) |
| 4. | Stress at 300% elongation, 5th draw (grams/tex) | 1.04 (0.89) |
| 5. | Permanent set (%) | 18 (18) |
| 6. | NO-test, $R_a$ | 0.52 |

The improved properties of the elastomeric polyurethane yarns are readily observed from the foregoing examples, and further experiments have been carried out to confirm such improvement within the scope of the present invention. As spandex type yarns, these improvements offer a much more satisfactory use in all kinds of stretch fabrics as well as being produced in a more rapid and economical manner.

The invention is hereby claimed as follows:

1. A method of producing a filamentary polyurethane of improved chemical resistance and physical properties which comprises:

preforming an elastomeric filamentary polyurethane which contains at least about 100 up to about 700 milliequivalents/kg. of terminal primary or secondary amino groups or a mixture thereof; and treating the preformed filamentary polyurethane with an organic polyisocyanate.

2. A method as claimed in claim 1 wherein said preformed polyurethane contains at least about 200 up to about 500 milliequivalents/kg. of said terminal amino groups.

3. A method as claimed in claim 1 wherein said preformed polyurethane contains approximately 200 to 400 milliequivalents/kg. of said terminal amino groups.

4. A method as claimed in claim 1 wherein said terminal amino groups have an aliphatic structure.

5. A method as claimed in claim 1 wherein the filamentary polyurethane is stretched about 10 to 130% during said treatment with the organic polyisocyanate.

6. A method as claimed in claim 1 wherein the filamentary polyurethane, after treatment with said polyisocyanate is heated at an elevated temperature of about 140°C. to 190°C.

7. A method as claimed in claim 5 wherein the filamentary polyurethane, after treatment with said polyisocyanate and simultaneous stretching of about 10 to 130%, is heated at an elevated temperature of about 160°C. to 180°C.

8. A method as claimed in claim 1 wherein the filamentary polyurethane is treated with an aliphatic diisocyanate.

9. A method as claimed in claim 8 wherein the diisocyanate is hexamethylene-diisocyanate-(1,6).

10. A method as claimed in claim 1 wherein the filamentary polyurethane is treated with a, diisocyanate dissolved as a 0.05 to 1.5 normal solution in an organic solvent.

11. A method as claimed in claim 10 wherein the organic solvent for the diisocyanate is toluene.

12. A method as claimed in claim 1 wherein said preformed elastomeric filamentary polyurethane is obtained by extruding a prepolymer of the polyurethane containing terminal isocyanate groups into a spinning bath containing a diamine.

13. A method as claimed in claim 12 wherein the diamine in the spinning bath is an aliphatic diamine.

14. A method as claimed in claim 12 wherein the spinning bath is an 0.3 to 3 normal solution of the diamine in an aromatic hydrocarbon solvent.

15. A method as claimed in claim 14 wherein the spinning bath is an 0.3 to 3 normal solution of ethylenediamine in toluene.

16. A method as claimed in claim 12 wherein the prepolymer of the polyurethane is one obtained by reaction of an initial polymer containing terminal hydroxy groups with an excess of toluene-diisocyanate.

17. A method as claimed in claim 12 wherein the prepolymer of the polyurethane is the reaction product of a polyester having terminal hydroxy groups and a polyisocyanate.

18. A method as claimed in claim 16 wherein the initial polymer containing terminal hydroxy groups reacted with the toluene-diisocyanate is in turn obtained by the reaction of a glycol, a dicarboxylic acid or their ester-forming derivatives and about 0.2 to 1.5 mol percent of a trivalent alcohol.

19. A method as claimed in claim 1 wherein the preforming of the elastomeric filamentary polyurethane and its aftertreatment with said polyisocyanate is carried out as a continuous operation.

20. The filamentary polyurethane product obtained by the process of claim 1.

21. The filamentary polyurethane product obtained by the process of claim 5.

22. The filamentary polyurethane product obtained by the process of claim 6.

23. The filamentary polyurethane product obtained by the process of claim 7.

* * * * *